US007182059B2

(12) United States Patent
Kawamura et al.

(10) Patent No.: US 7,182,059 B2
(45) Date of Patent: Feb. 27, 2007

(54) OIL PUMP MECHANISM FOR LUBRICATING SAW CHAIN

(75) Inventors: Kunimune Kawamura, Fuchu (JP); Tatsumi Uejima, Akiruno (JP)

(73) Assignee: Kioritz Corporation, Tokyo (JP)

( * ) Notice: Subject to any disclaimer, the term of this patent is extended or adjusted under 35 U.S.C. 154(b) by 53 days.

(21) Appl. No.: 11/166,129

(22) Filed: Jun. 27, 2005

(65) Prior Publication Data

US 2006/0000097 A1 Jan. 5, 2006

(30) Foreign Application Priority Data

Jul. 1, 2004 (JP) ..... 2004-195667

(51) Int. Cl.
*F01M 1/02* (2006.01)

(52) U.S. Cl. ..... 123/196 R; 184/27.1

(58) Field of Classification Search ..... 123/196 R, 123/196 A; 192/30 R, 105 CD, 113.5, 113 B; 494/43, 85, 901; 74/605, 125; 233/24, 23 R, 233/25; 475/83, 116, 101, 108, 137; 184/6.12, 184/6.16, 6.17, 6.18; 92/136
See application file for complete search history.

(56) References Cited

U.S. PATENT DOCUMENTS

| | | | | |
|---|---|---|---|---|
| 3,448,829 | A | 6/1969 | Rauh et al. | |
| 4,344,561 | A * | 8/1982 | Iizuka et al. | 192/30 R |
| 4,960,194 | A * | 10/1990 | Sageshima et al. | 192/103 B |
| 4,984,666 | A * | 1/1991 | Orii et al. | 192/223.4 |
| 5,315,971 | A * | 5/1994 | Yamada | 123/196 R |
| 5,577,587 | A * | 11/1996 | Jansson | 192/105 CD |
| 6,000,519 | A * | 12/1999 | Becker et al. | 192/105 CD |
| 6,253,896 | B1 * | 7/2001 | Notaras et al. | 192/105 CD |
| 6,394,249 | B1 * | 5/2002 | Tazumi et al. | 192/45 |

(Continued)

FOREIGN PATENT DOCUMENTS

| | | |
|---|---|---|
| DE | 1528028 | 12/1969 |
| JP | 2002-507496 | 3/2002 |
| WO | WO 99/48654 | 9/1999 |

(Continued)

OTHER PUBLICATIONS

"Maschinenelemente", Band I, 2. Auflage 1975, Von G. Niemann, pp. 320-323.
German Office Action dated Feb. 22, 2006.

*Primary Examiner*—Stephen K. Cronin
*Assistant Examiner*—Aaron N. Wilson
(74) *Attorney, Agent, or Firm*—Nixon Peabody LLP; Donald R. Studebaker

(57) ABSTRACT

An oil pump mechanism is incorporated in a chain saw having a centrifugal clutch and a saw chain adapted to be driven through the centrifugal clutch and activated in synchronization with the centrifugal clutch to supply a lubricating oil to the saw chain. The mechanism includes a crankshaft, a clutch shoe being mounted on the centrifugal clutch and being connected in driven relation to the crankshaft, a clutch drum disposed coaxially around the crankshaft, a worm fitted on the crankshaft by insertion in a freely rotatable manner and connected in driven relation to the clutch drum to be integrally rotated with the clutch drum, a driven gear engaged with the worm, and a movable pumping element for pumping the lubricating oil. The worm has an inner portion located opposed to the crankshaft and an outer portion including a tooth region. The inner portion is made of self-lubricating resin and the outer portion is made of wear-resistant metal.

4 Claims, 2 Drawing Sheets

U.S. PATENT DOCUMENTS 6,502,315 B2 * 1/2003 Menzel et al. ..... 30/381
6,837,209 B2 * 1/2005 Hori et al. ..... 123/196 R
6,899,070 B2 * 5/2005 Neal ..... 123/90.12
7,001,508 B2 * 2/2006 Kurokawa et al. ..... 210/168
7,007,780 B2 * 3/2006 Arnold et al. ..... 192/21
7,077,235 B2 * 7/2006 Eda et al. ..... 180/444
7,104,375 B2 * 9/2006 Czysz ..... 192/48.92

* cited by examiner

OIL PUMP MECHANISM FOR LUBRICATING SAW CHAIN

BACKGROUND OF THE INVENTION

1. Field of the Invention

The present invention relates to an oil pump mechanism, and more particularly, to an oil pump mechanism incorporated in a chain saw to lubricate a saw chain of the chain saw.

2. Description of the Related Art

A chain saw comprises a main body internally having a two-cycle internal combustion engine, a guide bar extending frontward from the main body, and a saw chain to be driven along a guide groove around the guide bar. The chain saw is driven by a driving force transmitted from the engine through a centrifugal clutch provided with a clutch shoe connected in driven relation to a crankshaft of the engine and a clutch drum disposed coaxially around the crankshaft.

There has been known one type of chain saw equipped with an oil pump mechanism designed to be activated in synchronization with the centrifugal clutch so as to supply a lubricating oil to the saw chain, as disclosed, for example, in U.S. Pat. No. 3,448,829 and Japanese Patent Laid-Open Publication No. 2002-507496. This oil pump mechanism comprises a worm fitted on the crankshaft by insertion in a freely rotatable manner and connected to the clutch drum so as to be integrally rotated with the clutch drum, a driven gear engaged with the worm, and a movable pumping element for pumping the lubricating oil.

There is the need for providing an oil pump mechanism with a worm structure capable of assuring adequate slidability relative to the crankshaft and sufficient strength in a gear tooth region, while facilitating reduction in production cost.

SUMMARY

Accordingly, the present invention is directed to providing an oil pump mechanism with a worm meeting the above need.

In one aspect of the present invention, an oil pump mechanism is incorporated in a chain saw having a centrifugal clutch and a saw chain adapted to be driven through the centrifugal clutch. The oil pump mechanism, which is activated in synchronization with the centrifugal clutch to supply a lubricating oil to the saw chain, includes a crankshaft, a clutch shoe mounted on the centrifugal clutch and connected in driven relation to the crankshaft, a clutch drum disposed coaxially around the crankshaft, a worm fitted on the crankshaft by insertion in a freely rotatable manner and connected in driven relation to the clutch drum so as to be integrally rotated with the clutch drum, a driven gear engaged with the worm, and a movable pumping element for pumping the lubricating oil. The worm has an inner portion located opposed to the crankshaft and an outer portion including a tooth region. The inner portion is made of self-lubricating resin and the outer portion is made of wear-resistant metal.

In another aspect of the present invention, a chain saw includes such an oil pump mechanism.

Another aspect of the present invention is providing, at a lower production cost, an oil pump mechanism with a worm structure capable of assuring adequate slidability relative to the crankshaft and sufficient strength in a gear tooth region.

BRIEF DESCRIPTION OF DRAWINGS

The accompanying drawings, which are included to provide a further understanding of the invention and are incorporated in and constitute a part of this specification, illustrate examples of the invention that together with the description serve to explain the principles of the invention. In the drawings.

DETAILED DESCRIPTION

These and other aspects of the invention will now be described in connection with an exemplary embodiment illustrated in the accompanying drawings.

Figure 1:
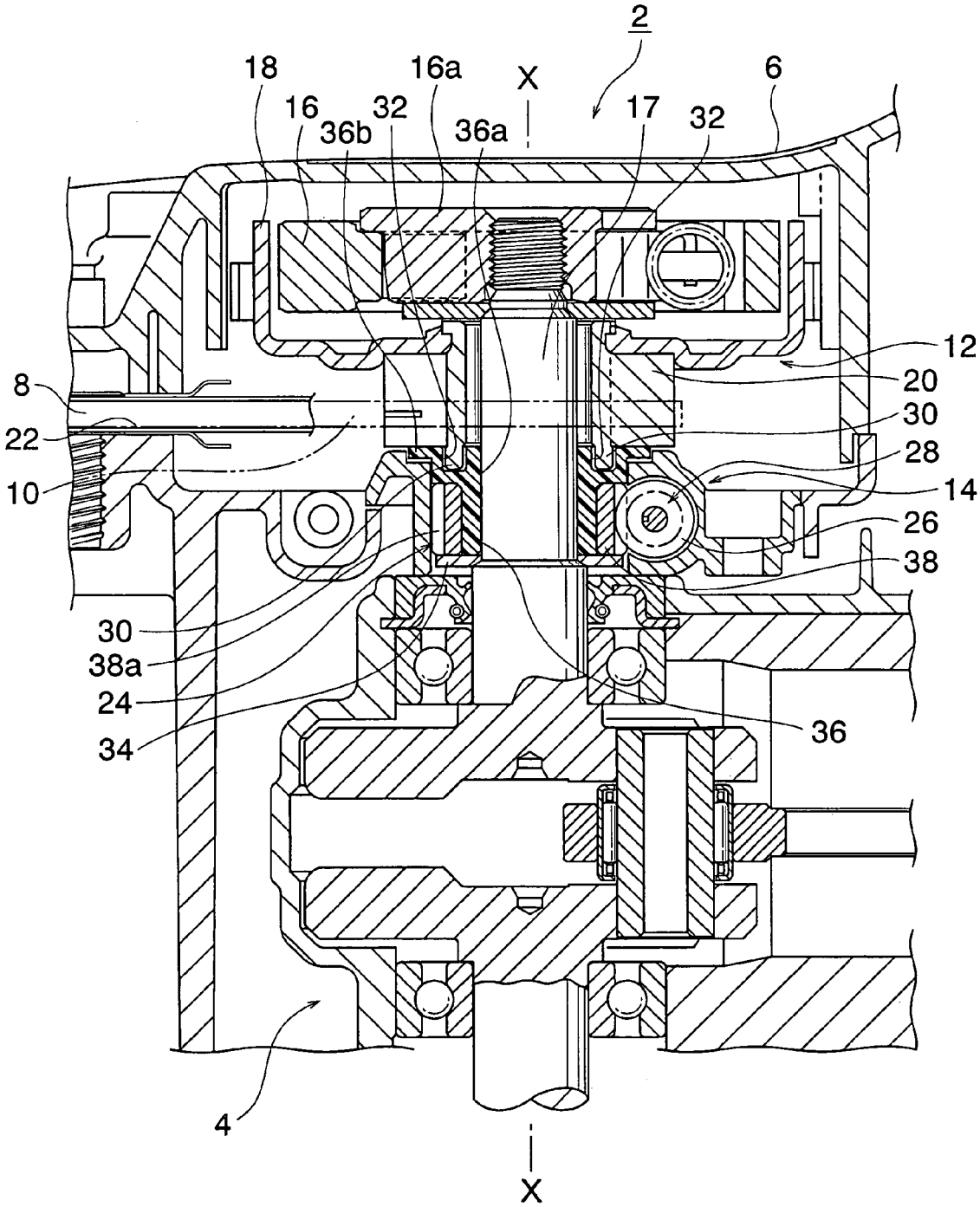
FIG. 1 is a fragmentary horizontal sectional view showing an oil pump mechanism according to a first embodiment of the present invention, taken along a crankshaft in a main body of a chain saw.

With reference to FIG. 1, an oil pump mechanism 14 according to an example of the present invention will now be described. FIG. 1 is a fragmentary horizontal sectional view showing an oil pump mechanism according to a first embodiment of the present invention, taken along a crankshaft in a main body 6 of a chain saw 2.

The chain saw 2 comprises the main body 6 internally having an engine 4, such as a small air-cooled two-cycle gasoline engine, a guide bar 8 extending frontward from the main body 6, a saw chain 10 to be driven along a guide groove 22 around the guide bar 8, a centrifugal clutch 12 for transmitting a driving force from the engine 4 to the saw chain 10, and an oil pump mechanism 14 for supplying a lubricating oil to the saw chain 10.

The centrifugal clutch 12 is provided with a clutch shoe 16 connected in driven relation to a crankshaft 17 of the engine 4 and a clutch drum 18 disposed coaxially around the crankshaft 17. The clutch drum 18 includes a sprocket 20 disposed coaxially around the crankshaft 17 and attached thereto so as to be integrally rotated therewith in a freely rotatable manner relative to the crankshaft 17. The saw chain 10 is wound around the sprocket 20 and the guide groove 22 of the guide bar 8.

The oil pump mechanism 14 includes: a worm 24 disposed coaxially around the crankshaft 17 and connected in driven relation to the sprocket 20 so as to be integrally rotated with the clutch drum 18 and the sprocket 20; a driven gear 26 engaged with the worm 24; and a movable pumping element 28 integrated with the driven gear 26 and composed of a rotary plunger pump for pumping the lubricating oil. That is, the worm 24 is connected in driven relation to the clutch drum 18 through the sprocket 20.

A structure and assembling operation for attaching the worm 24 to the sprocket 20 will be described in more detail below. The sprocket 20 has a first end surface serving as a portion of the clutch drum 18 to which the worm 24 is to be connected, and the first end surface is formed with a protrusion 30 (two protrusions in the illustrated embodiment) extending in a direction of a rotational axis X—X of the crankshaft 17. Correspondingly, the worm 24 has a second end surface located opposed to the clutch drum 18, and the second end surface is formed with a concave portion 32, for example, a hole, for receiving the protrusion 30 therein. The crankshaft 17 has a stopper ring 34 attached thereon in a fitting manner. In the assembling operation, the worm 24 is firstly inserted along the crankshaft 17 and brought into contact with the stopper ring 34, and then the clutch drum 18 having the sprocket 20 attached thereto is inserted along the crankshaft 17. During this operation, the protrusion 30 of the sprocket 20 is inserted into the concave portion 32 of the worm 24. Thus, the worm 24 is fixedly attached to the sprocket 20 in an integrally rotatable manner. Then, a boss member 16*a* for guiding the clutch shoe 16 is fixed to the tip of the crankshaft 17 with a screw.

The worm 24 has an inner portion 36 located opposed to the crankshaft 17, and a cylindrical outer portion 38 including a tooth region 38*a*. The inner portion 36 is made of self-lubricating resin, and the outer portion 38 is made of wear-resistant metal. In this embodiment, the inner portion 36 of the worm 24 has a cylindrical region 36*a* extending along the outer portion 38 in the direction of the rotational axis X—X, and a flange region 36*b* integrally formed with the cylindrical region 36*a* to be located opposed to the sprocket 20. The inner portion 36 is integrated with the outer portion 38 by appropriate means. The concave portion 32 is formed in the flange region 36*b* of the inner portion 36. Preferably, the self-lubricating resin to be used for forming the inner portion 36 is a nylon-based resin containing carbon.

The movable pumping element 28 has a conventional structure commonly used as a rotary plunger pump, and its detailed description is omitted. Generally, the movable pumping element 28 can be provided with an end cam (not shown). Through the worm 24 and the driven gear 26, the rotation of the centrifugal clutch 12 is transmitted to the movable pumping element 28. The movable pumping element 28 is rotated about its axis, and, during the rotation, periodically reciprocated along the axial direction by the action of the end cam so as to pump a lubricating oil in an oil pump (not shown) to the saw chain 10.

The oil pump mechanism according to this embodiment is operated as follows.

When the engine 4 is started, and a rotational speed of the crankshaft 17 is increased from that in the idle state, the clutch shoe 16 is moved outward by a centrifugal force and connected in driving relation to the clutch drum 18. Thus, the clutch drum 18 is rotated, and the sprocket 20 and the worm 24 are rotated around the crankshaft 17. According to the rotation of the sprocket 20, the saw chain 10 is driven along the guide groove 22 around the guide bar 8. Simultaneously, according to the rotation of the worm 24, the driven gear 26 is rotated to activate the movable pumping element 28 in the aforementioned manner so as to pump a lubricating oil to the saw chain 10.

Figure 2:
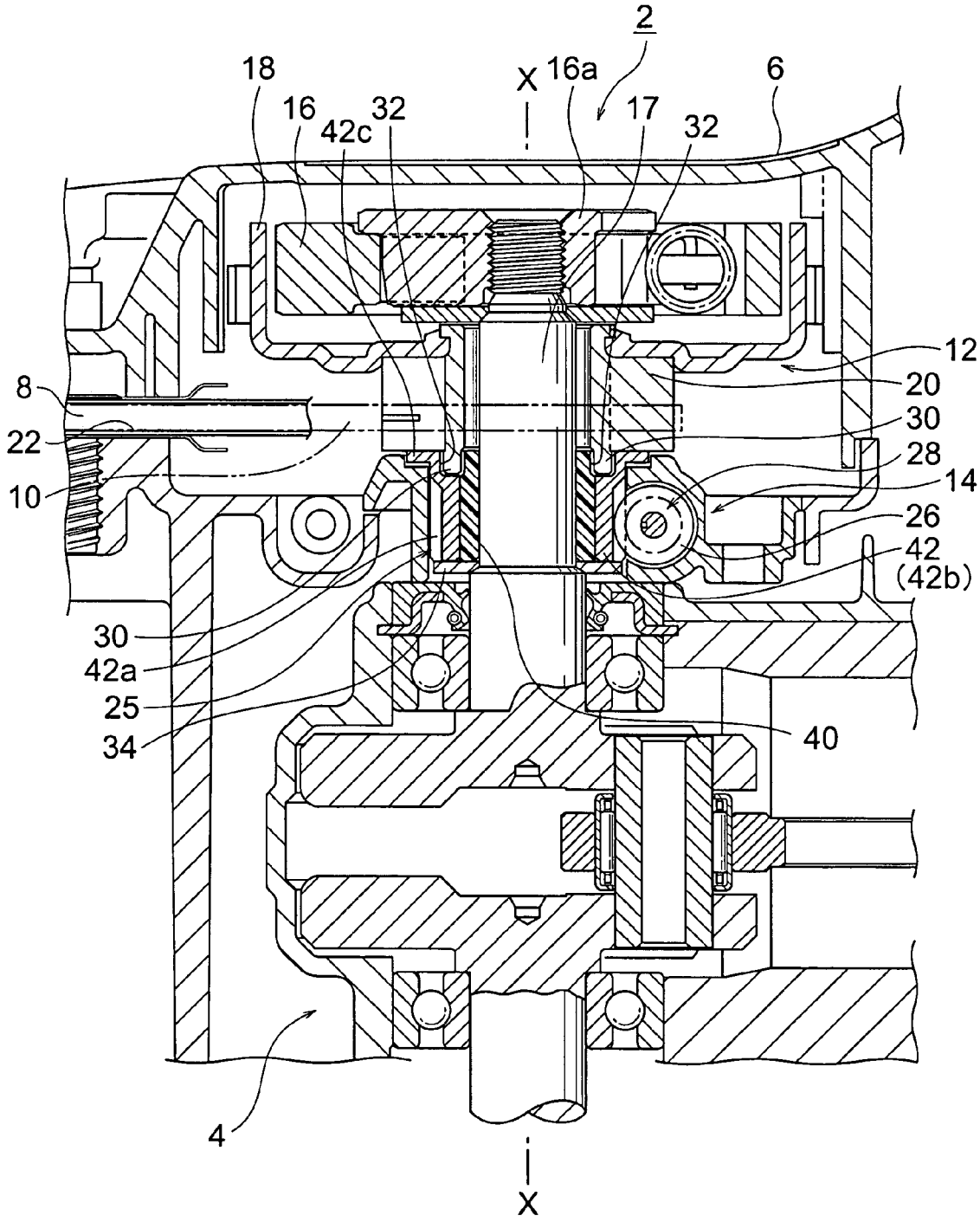
FIG. 2 is a fragmentary horizontal sectional view showing an oil pump mechanism according to a second embodiment of the present invention, taken along a crankshaft in a main body of a chain saw.

FIG. 2 is a fragmentary horizontal sectional view showing an oil pump mechanism 14 according to a second embodiment of the present invention, taken along a crankshaft in a main body of a chain saw 2.

As compared to the first example, the oil pump mechanism 14 according to the second embodiment is structurally different only in a part of the above worm 24, and the remaining structure of the chain saw 2 is the same as that in the first example. Thus, same components or elements defined by the same reference numeral or code as in the FIG. 1 example, and its detailed description, will be omitted. The following description will be made only about the different point.

As shown in FIG. 2, while a worm 25 in the second example is the similar to the worm 24 in the first example in that it has a cylindrical inner portion 40 located opposed to the crankshaft 17 and an outer portion 42 including a tooth region 42*a*, and the inner portion 40 and the outer portion 42 are made, respectively, of self-lubricating resin and wear-resistant metal, the second embodiment is different from the first example in that the outer portion 42 including the tooth region 42*a* has a cylindrical region 42*b* extending along the cylindrical inner portion 40 in the direction of the rotational axis X—X, and a flange region 42*c* integrally formed with the cylindrical region 42*b* to be located opposed to the sprocket 20.

The concave portion 32 is formed in the flange region 42*c* of the outer portion 42.

In the first and second examples, the first end surface of the clutch drum located opposed to the worm, and the second end surface of the worm located opposed to the first end surface of the clutch drum are formed, respectively, with either one of the protrusion extending in the direction of the rotational axis (X—X) and the concave portion receiving therein the protrusion in a fitting manner, and the other one of the protrusion and the concave portion. Thus, after simply inserting the worm along the crank shaft, the worm can be readily attached to a portion of the clutch drum, or the sprocket 20.

It is to be understood that the present invention is not limited to the above examples, but various changes and modifications may be made therein without departing from the spirit and scope thereof as set forth in appended claims, all of which are intended to be encompassed within the scope thereof.

For example, while the concave portion 32 and the protrusion 30 in the first and second examples are formed, respectively, in the worm 24, 25 and the sprocket 20, this arrangement may be reversed, or the protrusion 30 and the concave portion 32 (hole) may be formed, respectively, in the worm 24, 25 and the sprocket 20.

Thus, it is intended that the present invention cover the modifications of this invention provided they come within the scope of the appended claims and their equivalents.

What is claimed is:

1. An oil pump mechanism, which is incorporated in a chain saw having a centrifugal clutch and a saw chain adapted to be driven through said centrifugal clutch, and which is activated in synchronization with said centrifugal clutch to supply a lubricating oil to said saw chain, including:

a crankshaft;

a clutch shoe being mounted on said centrifugal clutch and being connected in driven relation to said crankshaft;

a clutch drum disposed coaxially around said crankshaft;

a worm fitted on said crankshaft by insertion in a freely rotatable manner, and connected in driven relation to said clutch drum so as to be integrally rotated with said clutch drum;

a driven gear engaged with said worm; and a movable pumping element for pumping said lubricating oil, wherein said worm has an inner portion located opposed to said crankshaft and an outer portion including a tooth region, said inner portion being made of self-lubricating resin, and said outer portion being made of wear-resistant metal.

2. A chain saw comprising the oil pump mechanism as defined in claim 1.

3. The oil pump mechanism as defined in claim 1, wherein said clutch drum has first end surface located opposed to said worm, and said worm has a second end surface located opposed to said first end surface, either one of said first and second end surfaces being formed with a protrusion extending in a direction of a rotational axis of said crankshaft, the other end surface being formed with a concave portion receiving therein said protrusion in a fitting manner.

4. A chain saw comprising the oil pump mechanism as defined in claim 3.

* * * * *